US007032326B2

(12) United States Patent
Hong

(10) Patent No.: US 7,032,326 B2
(45) Date of Patent: Apr. 25, 2006

(54) APPARATUS FOR DRIVING DRUM OF CLOTHES DRYER

(75) Inventor: Kyung-Seop Hong, Incheon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/995,312

(22) Filed: Nov. 24, 2004

(65) Prior Publication Data

US 2005/0223592 A1 Oct. 13, 2005

(30) Foreign Application Priority Data

Apr. 7, 2004 (KR) ..... 10-2004-0023842

(51) Int. Cl.
*F26B 11/02* (2006.01)

(52) U.S. Cl. ..... 34/602

(58) Field of Classification Search ..... 34/596, 34/601, 602, 603, 604; 198/345.3
See application file for complete search history.

(56) References Cited

U.S. PATENT DOCUMENTS 2,694,867 A * 11/1954 Smith ..... 34/605
4,317,291 A * 3/1982 Weststrate et al. ..... 34/103
4,844,231 A * 7/1989 Usui ..... 198/345.3

FOREIGN PATENT DOCUMENTS

KR 2003-0049861 A 6/2003

* cited by examiner

*Primary Examiner*—S. Gravini
(74) *Attorney, Agent, or Firm*—Birch, Stewart, Kolasch & Birch, LLP

(57) ABSTRACT

An apparatus for driving a drum of a clothes dryer having a drum for accommodating clothes to be dried in a cabinet, the apparatus comprises: a driving motor for generating a driving force to rotate the drum; and a roller connected to a rotational shaft of the driving motor and contacting an outer circumferential surface of the drum, for transmitting a driving force of the driving motor to the drum. According to this, a reliability of an operation for rotating the drum can be increased.

17 Claims, 3 Drawing Sheets

APPARATUS FOR DRIVING DRUM OF CLOTHES DRYER

BACKGROUND OF THE INVENTION

1. Field of the Invention

The present invention relates to a clothes dryer, and more particularly, to an apparatus for driving a drum of a clothes dryer.

2. Description of the Conventional Art

Generally, a clothes dryer is separately installed from a washing machine thereby to automatically dry wet clothes that has completed a washing operation. According to a drying method, the clothing dryer can be divided into a condensation type and an exhaust type.

The condensation type clothing dryer is provided with a heat exchanger for condensing moisture included in air that has passed through a drum therein. The condensation type clothing dryer circulates air therein thus to discharge condensed water outwardly, and heats dry air by a heater thus to supply into the drum, thereby drying clothes inside the drum.

The exhaust type clothing dryer sucks external air, heats the sucked air by a heater thus to introduce into a drum, and discharges air that has passed through the drum outwardly, thereby drying clothes inside the drum.

As shown in FIG. 1, the conventional exhaust type clothing dryer comprises: a cabinet 10 having an inlet 10*a* for introducing clothes and a door 11 for opening and closing the inlet 10*a* at a front side thereof; a drum 12 rotatably installed in the cabinet 10 and for accommodating clothes therein; an air circulation device 15 for sucking external air into the cabinet 10 thereby introducing into the drum 12, and discharging air that has passed through the drum 12 to outside of the cabinet 10; a heater 16 for heating air introduced into the drum 12; and a drum rotation device 14 for rotating the drum 12.

The air circulation device 15 includes: a suction port 15*a* formed at a rear upper side of the cabinet 100, for sucking external air into the cabinet 10; a suction duct 15*b* respectively connected to inside of the cabinet 10 and an opening portion 12*b* formed at a rear side of the drum 12, for introducing air that has been sucked into the cabinet 10 into the drum 12; a fan 15*c* installed at the suction duct 15*b* and rotated, for sucking external air and thereby generating a suction force to introduce the sucked air into the drum 12; and an exhaust duct 15*d* connected to an opening portion 12*a* formed at a front side of the drum 12, for discharging air that has passed through the drum 12 to outside of the cabinet 10.

The heater 16 is installed in the suction duct 15*b* thereby to heat air introduced into the drum 12 after passing through the suction duct 15*b*.

The drum rotation device is composed of: a driving motor 13 arranged at one side of the drum 12 and generating a rotational force; a pulley 14*a* installed at a rotational shaft of the driving motor 13; and a belt 14*b* installed to cover outer circumferences of the drum 12 and the pulley 14*a*, for transmitting a rotational force of the driving motor 13 to the drum 12. The driving motor 13 is also connected to the fan 15*c* thereby to rotate the fan 15*c*.

In the conventional clothes dryer, when the driving motor 13 and the heater 16 are operated, the drum 12 connected to the driving motor 13 through the pulley 14*a* and the belt 14*b* is rotated thereby to stir clothes accommodated in the drum 12. As the driving motor 13 is rotated, the fan 15*c* is operated and thereby external air is sucked into the cabinet 10 through the suction port 15*a*. The sucked air is introduced into the suction duct 15*b* and is heated by the heater 16 thus to be introduced into the drum 12.

The air of high temperature that has been introduced into the drum 12 deprives moisture of the clothes inside the drum 12, and the air including the moisture is discharged outside the cabinet 10 through the exhaust duct 15*d*. According to this, the wet clothes inside the drum 12 is dried.

However, in the conventional clothes drier, the drum 12 is rotated as a driving force of the driving motor 13 is transmitted to the drum 12 through the belt 14*b*. According to this, the belt 14*b* is easily worn away thus to be damaged, and a slip is generated between the belt 14*b* and the drum 12. Therefore, the drum 12 is not smoothly rotated thus to damage the clothes inside the drum 12 by the air of high temperature.

Also, since the drum 12 has to be completely separated from the cabinet 10 in order to replace the belt 14*b*, the replacement process is very complicated.

SUMMARY OF THE INVENTION

Therefore, an object of the present invention is to provide an apparatus for driving a drum of a clothes dryer capable of increasing a reliability and an operationality and solving problems due to a belt usage by rotating a drum by using a roller contacting an outer circumferential surface of the drum without using a belt.

To achieve these and other advantages and in accordance with the purpose of the present invention, as embodied and broadly described herein, there is provided an apparatus for driving a drum of a clothes dryer having a drum for accommodating clothes to be dried in a cabinet, the apparatus comprising: a driving motor for generating a driving force to rotate the drum; and a roller contacting an outer circumferential surface of the drum and transmitting a driving force of the driving motor to the drum.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Hereinafter, preferred embodiments of the present invention will be explained with reference to the attached drawings.

Figure 1:
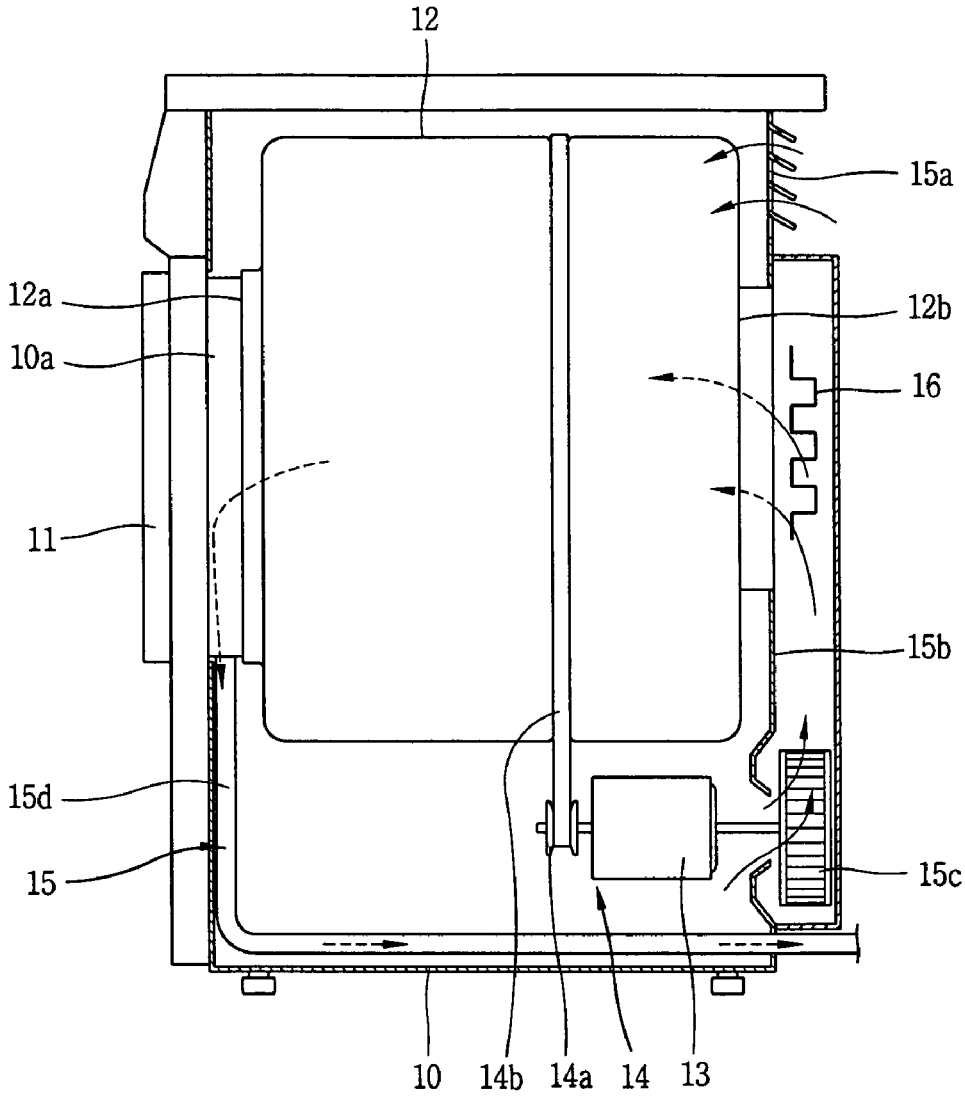
FIG. 1 CONVENTIONAL ART
FIG. 1 is a lateral view showing a clothes dryer in accordance with the conventional art.
Figure 2:
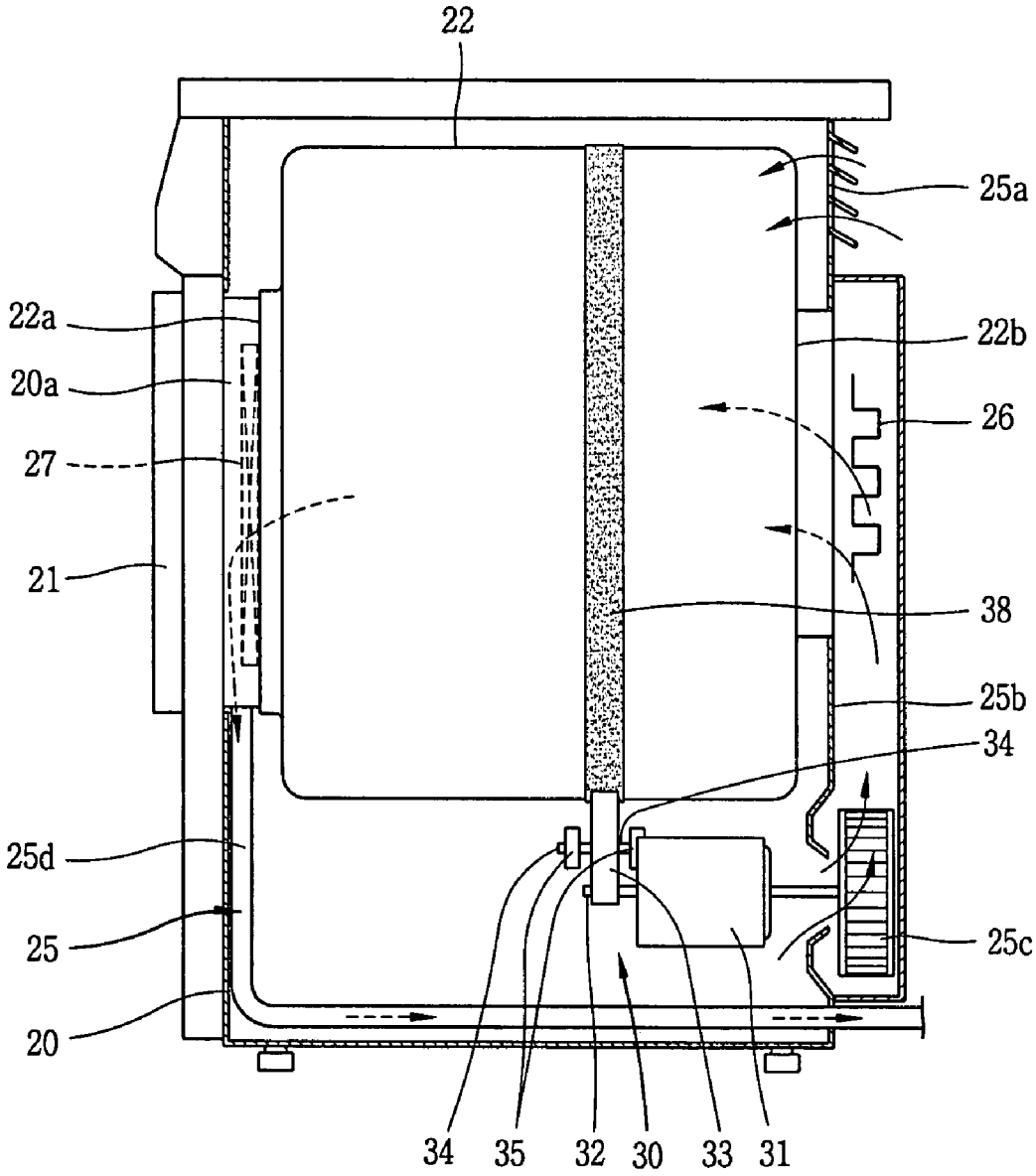
FIG. 2 is a lateral view showing a clothes dryer according to the present invention.

As shown in FIG. 2, a clothes dryer according to the present invention comprises: a cabinet 20 having an inlet 20*a* for introducing clothes and a door 21 for opening and closing the inlet 20*a* at a front side thereof; a drum 22 rotatably installed in the cabinet 20 and for accommodating clothes therein; an air circulation device 25 for sucking external air into the cabinet 20 thereby introducing into the drum 22, and discharging air that has passed through the drum 22 outwardly; a heater 26 for heating air introduced into the drum 22; and a drum rotation device 30 for rotating the drum 22.

The air circulation device 25 includes: a suction port 25*a* formed at a rear upper side of the cabinet 20, for sucking external air into the cabinet 20; a suction duct 25*b* respectively connected to inside of the cabinet 20 and an opening portion 22*b* formed at a rear side of the drum 22, for introducing air that has been sucked into the cabinet 20 into the drum 22; a fan 25*c* installed in the suction duct 25*b* and rotated, for sucking external air and thereby generating a suction force to introduce the sucked air into the drum 22; and an exhaust duct 25*d* connected to an opening portion 22*a* formed at a front side of the drum 22, for discharging air that has passed through the drum 22 outwardly; and a filter 27 installed at the opening portion 22*a* of the drum 22, for filtering foreign materials such as clothes thread included in the air discharged from the drum 22.

Figure 3:
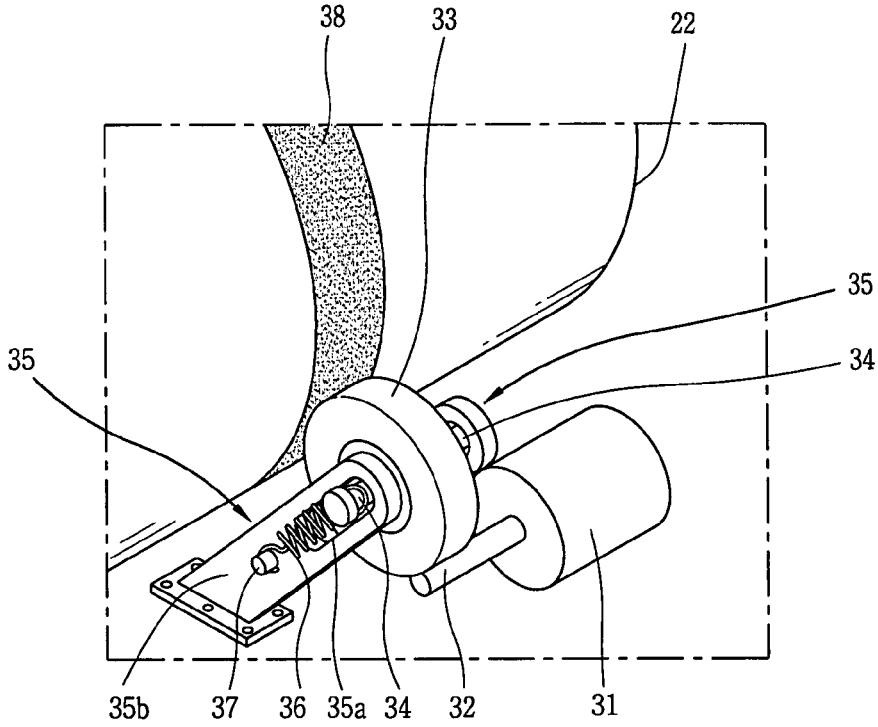
FIG. 3 is a perspective view showing an apparatus for driving a drum of a clothes dryer according to the present invention.
Figure 4:
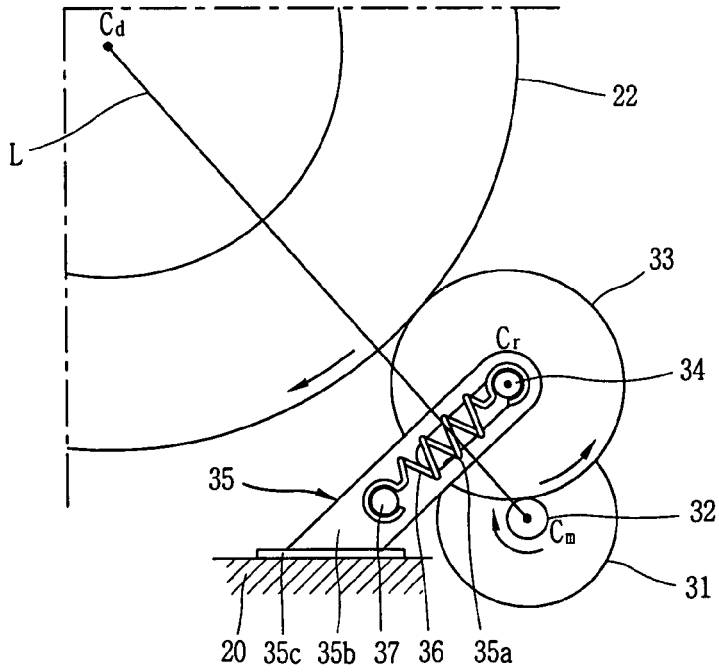
FIG. 4 is a frontal view schematically showing the apparatus for driving a drum of a clothes dryer according to the present invention.

As shown in FIGS. 3 and 4, the drum rotation device 30 includes: a driving motor 31 installed at one side of the drum 22 and generating a rotational force; a roller 33 arranged between a rotational shaft 32 of the driving motor 31 and the outer circumferential surface of the drum 22, for transmitting a rotational force of the rotational shaft 32 to the drum 22; and a supporter 35 fixed to the cabinet 20 or the driving motor 31 and connected to a supporting shaft 34 elongated to both sides of the roller 33, for supporting the roller 33. The driving motor 31 is also connected to the fan 25*c* thus to rotated the fan 25*c*.

An outer circumferential surface of the roller 33 is in contact with the outer circumferential surface of the drum 22 and the outer circumferential surface of the rotational shaft 32 of the driving motor 31. A rotation center Cr of the roller 33 is installed to be distant from an imaginary line L connecting a rotation center Cd of the drum 22 and a rotation center Cm of the rotational shaft 32 of the driving motor 31 with a certain distance. The roller is preferably formed of a synthetic resin such as urethane or rubber having a high frictional coefficient.

The supporter 35 is composed of: a supporting portion 35*b* having an insertion hole 35*a* into which the supporting shaft 34 elongated to both sides of the rotation center of the roller 33 is inserted; and a fixing portion 35*c* installed at one end of the supporting portion 35*b*, for fixing the supporting portion 35*b* to the cabinet 20 or the driving motor 31 by a coupling means such as a bolt or by a welding.

Preferably, an elastic member 36 for providing a force to pull the roller 33 towards the connection line L is installed in order to smoothly transmit a driving force among the rotational shaft 32, the roller 33, and the drum 22 by increasing an adhesion force between the roller 33 and the outer circumferential surface of the drum 22 and between the roller 33 and the outer circumferential surface of the rotational shaft 32.

One end of the elastic member 36 is connected to the supporting shaft 34 of the roller 33, and another end thereof is connected to a protrusion 37 formed at the supporting portion 35*b* of the supporter 35. Since the adhesion force between the roller 33 and the outer circumferential surface of the drum 22 and between the roller 33 and the outer circumferential surface of the rotational shaft 32 is increased by the elastic member 36, a driving force can be smoothly transmitted therebetween even if the roller 33 is worn away.

The insertion hole 35*a* of the supporter 35 is elongated to a direction almost perpendicular to the connection line L thereby to guide a motion of the supporting shaft 34 when a force of the elastic member 36 is applied to the supporting shaft 34.

A friction member 38 for preventing a sliding between the roller 33 and the drum 22 is preferably installed at the outer circumferential surface of the drum 22 contacting the roller 33. The friction member 38 is preferably formed of a synthetic resin such as urethane or rubber.

In the clothes dryer according to the present invention, when the driving motor 31 and the heater 26 are operated, the roller 33 is rotated by a rotation of the rotational shaft 32 and thereby the drum 12 is rotated. As the driving motor 31 is operated, the fan 25*c* is operated and thereby external air is sucked into the cabinet 20 through the suction port 25*a*. The sucked air is introduced into the suction duct 25*b* and is heated by the heater 26 thus to be introduced into the drum 22.

The air of high temperature that has been introduced into the drum 22 deprives moisture of the clothes inside the drum 22, and the air including the moisture is discharged outside the cabinet 20 through the exhaust duct 25*d*. By the above processes, the wet clothes inside the drum 22 are dried.

In the apparatus for driving a drum of a clothes dryer according to the present invention, the roller 33 contacting the outer circumferential surface of the drum 22 is used without using a belt when the drum 22 is to be rotated. According to this, a problem due to a belt usage is solved, and a reliability and operationality can be increased.

Additionally, since the elastic member 36 is provided in order to increase an adhesion force between the roller 33 and the outer circumferential surface of the drum 22 and between the roller 33 and the outer circumferential surface of the rotational shaft 32, a driving force can be smoothly transmitted among the rotational shaft 32, the roller 33, and the drum 22 regardless of an abrasion of the roller 33.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An apparatus for driving a drum of a clothes dryer having a drum for accommodating clothes to be dried in a cabinet, the apparatus comprising:

a driving motor for generating a driving force to rotate the drum; and a roller connected to a rotational shaft of the driving motor and contacting an outer circumferential surface of the drum, for transmitting a driving force of the driving motor to the drum; and wherein an outer circumferential surface of the roller is in contact with an outer circumferential surface of the rotational shaft of the driving motor.

2. The apparatus of claim 1, further comprising a friction member installed at an outer circumferential surface of the drum contacting the roller.

3. The apparatus of claim 2, wherein the friction member is made of a synthetic resin.

4. The apparatus of claim 1, wherein the roller is made of a synthetic resin.

5. An apparatus for driving a drum of a clothes dryer having a drum for accommodating clothes to be dried in a cabinet, the apparatus comprising:

a driving motor for generating a driving force to rotate the drum; and a roller connected to a rotational shaft of the driving motor and contacting an outer circumferential surface of the drum for transmitting a driving force of the driving motor to the drum; and wherein a rotation center of the roller is distant from an imaginary line connecting a rotation center of the drum and a rotation center of the rotational shaft of the driving motor with a certain distance.

6. The apparatus of claim 5, further comprising an elastic member for providing a force towards the connection line to the roller.

7. The apparatus of claim 6, further comprising a supporter having an insertion hole into which a supporting shaft elongated from both sides of the rotation center of the roller is inserted, and fixed to the cabinet or the driving motor thereby for supporting the roller.

8. The apparatus of claim 7, wherein the insertion hole of the supporter is elongated to a direction almost perpendicular to the connection line.

9. The apparatus of claim 8, wherein the elastic member is connected to the supporting shaft of the roller and supported at the supporter.

10. An apparatus for driving a drum of a clothes dryer having a drum for accommodating clothes to be dried in a cabinet, the apparatus comprising:

a driving motor for generating a driving force to rotate the drum;

a roller connected to a rotational shaft of the driving motor and contacting an outer circumferential surface of the drum, for transmitting a driving force of the driving motor to the drum; and an elastic member for providing the roller with a force towards an imaginary connection line which connects a rotation center of the drum and a rotation center of the rotational shaft of the driving motor with a center distance, wherein a rotation center of the roller is deviated from the imaginary connection line.

11. The apparatus of claim 10, wherein a friction member is installed at an outer circumferential surface of the drum contacting the roller.

12. The apparatus of claim 11, wherein the friction member is formed of a synthetic resin.

13. The apparatus of claim 10, wherein the roller is formed of a synthetic resin.

14. The apparatus of claim 10, wherein an outer circumferential surface of the roller is in contact with an outer circumferential surface of the rotational shaft of the driving motor.

15. The apparatus of claim 10, further comprising a supporter having an insertion hole into which a supporting shaft elongated from both sides of the rotation center of the roller is inserted, and fixed to the cabinet or the driving motor thereby for supporting the roller.

16. The apparatus of claim 15, wherein the insertion hole of the supporter is elongated to a direction perpendicular to the connection line.

17. The apparatus of claim 16, wherein the elastic member is connected to the supporting shaft of the roller and supported at the supporter.

* * * * *